US005704847A

United States Patent [19]

Glennon

[11] Patent Number: 5,704,847

[45] Date of Patent: Jan. 6, 1998

[54] GOLF CLUB SUPPORT CARD

[76] Inventor: Edward V. Glennon, 5191 Lakeside Dr., Palm Springs, Calif. 92264

[21] Appl. No.: 734,124

[22] Filed: Oct. 21, 1996

[51] Int. Cl.[6] ..... A63B 55/00

[52] U.S. Cl. ..... 473/282

[58] Field of Search ..... 473/131, 386, 473/407, 408; 40/621, 586, 606; D12/193

[56] References Cited

U.S. PATENT DOCUMENTS

| | | | |
|---|---|---|---|
| D. 2,372 | 7/1866 | Locher | D20/22 |
| 22,531 | 6/1859 | Ford | 370/276 |
| D. 136,395 | 7/1943 | Deckman | D10/64 |
| D. 167,878 | 10/1952 | Bessolo | D12/193 |
| D. 279,309 | 6/1985 | Rosen et al. | D21/234 |
| D. 364,439 | 11/1995 | Ragusin | D21/234 |
| 2,419,175 | 7/1947 | Spohrer | 150/1.5 |
| 3,683,529 | 8/1972 | Reed | 40/621 |
| 4,063,731 | 12/1977 | Kitay | 473/286 |
| 4,616,749 | 10/1986 | Briggs | 473/282 |
| 4,960,212 | 10/1990 | Wu | 211/70.2 |

*Primary Examiner*—Sebastiano Passaniti
*Assistant Examiner*—Stephen L. Blan
*Attorney, Agent, or Firm*—Sand & Sebolt

[57] ABSTRACT

A one-piece rectangular card-like member formed of a flexible plastic material has a plurality of concave notches formed in side and end edges of the card for receiving a shaft of a golf club therein to support the grip end of the club off the ground when the card is extending vertically from the ground. Printed indicia is placed on flat side surfaces of the card and a hole may be formed through the card adjacent one end edge. The card has a length of approximately 3 5/16 inches and a width of approximately 2 1/8 inches and a thickness of approximately 0.25 inches. The card has straight edges which terminate in smooth rounded corners and is easily carried by the golfer in his or her pocket or wallet.

20 Claims, 2 Drawing Sheets

GOLF CLUB SUPPORT CARD

BACKGROUND OF THE INVENTION

1. Technical Field

The invention relates to a golfing tool and more particularly to a extremely simple and inexpensive plastic card which resembles a usual credit card, which supports the club grip end above the ground in a simple and effective manner.

2. Background Information

During a round of golf the golfer on many occasions will take an extra club from the bag or cart and place one of the clubs on the ground while using the other to avoid going back to the cart or bag. This usually occurs around the green where the golfer will carry his putter and chipper.

It is desirable that the grip end of the club not be laid on the ground, especially when the ground is moist from rain or dew to prevent the grip from becoming slippery or possible damage to the club grip which is usually formed of leather or other sensitive material. Therefore, various devices have been used to enable the grip end of the club to be supported above the ground for use in such situations.

Various devices and golfing tools have been developed which includes a feature for supporting a golf club shaft off of the ground, most of which are incorporated into such a device containing other features. However, all of these prior devices require it to be inserted into the ground prior to placing the golf club shaft thereon. Likewise, these devices are of various shapes and configurations and are a difficult to store and carry by the golfer. Examples of such prior art devices are shown in U.S. Pat. Nos. 2,887,137; 4,616,749; 5,226,647; 5,393,052; 4,007,928; 5,116,046; 5,230,507; 5,401,019; 4,063,731; 5,143,371; 5,292,120; D2,372; D22,531; D136,395; D364,439; 2,419,175; and 4,063,731.

These prior devices have the disadvantage of leaving a mark or hole in the ground which is undesirable, especially when used on the green. Likewise, these prior devices requiring penetration of the ground may be difficult to use where the ground is extremely hard as occurs during the summer time season, of if the ground is rocky or sandy.

Furthermore, these prior devices are expensive to manufacture and produce, thereby requiring that the same be sold even if at a normal price in order to cover the manufacturing cost and provide a profit to the proceducer. This makes such devices impractical for free give-away promotional items. Also most of these prior devices do not provide for any support height adjustment to compensate for different grass heights etc.

SUMMARY OF THE INVENTION

Objectives of the invention include providing an extremely simple, inexpensive card for use by golfers which is formed of a flexible plastic material which temporarily supports the grip end of a golf club above the ground to prevent the grip from becoming slippery or wet.

Another objective is to provide such a card which has a substantially rectangular configuration with four edges, certain of which are formed with concave notches for receiving a portion of a golf club shaft therein when supporting the grip above the ground, and which is utilized without requiring any penetration of the ground to prevent damage thereto, such as to a golf course green, and which by simple rotation can adjust the height by which the grip is supported above the ground to compensate for various lengths of grass.

A further objective of the invention is to provide such a card which resembles a usual credit card and which can be carried and stored easily in the golfers wallet or pocket, and which may have a small hole for receiving an attachment cord or string for attaching or supporting the card on an object.

Another objective of the invention is to provide such a card having relatively flat opposed surfaces providing adequate area for receiving printed indicia thereon to provide advertising thereby enabling the card to be used as a promotional item by companies and/or individuals.

These objectives and advantages are obtained by the card of the present invention, the general nature of which may be stated as card for supporting a portion of a golf club shaft above the ground, wherein the card is a one piece member formed of plastic material having a a substantially rectangular shape with a pair of opposed flat side surfaces defined by a pair of parallel end edges and a pair of parallel side edges, in which at least one concave notch is formed in one of the end edges and in at least one of the side edges for receiving a shaft of a golf club therein when the opposite end edge or side edge is seated on the ground for supporting the card in an upright position; and in which printed indicia is placed on at least one of the side surfaces.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

The novel golf club support card of the present invention is indicated generally at 1, and includes a one piece member formed of a flexible plastic material, having a pair of flat planar opposed side surfaces 2 and 3, a pair of opposed parallel side edges 5 and 6, and a pair of opposed parallel end edges 7 and 8. The side and end edges are joined by smoothly curved corners 10.

Figure 1:
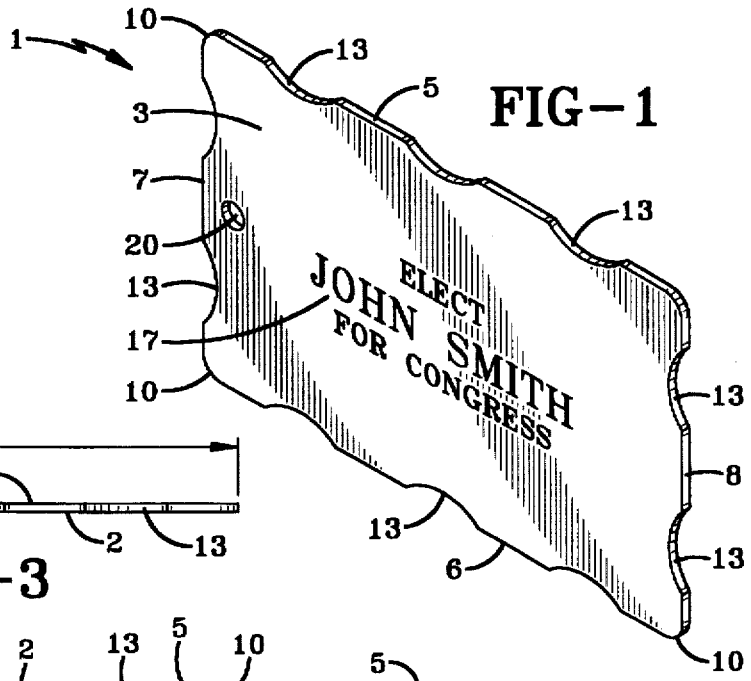
FIG. 1 is a perspective view of the golf club support card of the present invention.
Figure 2:
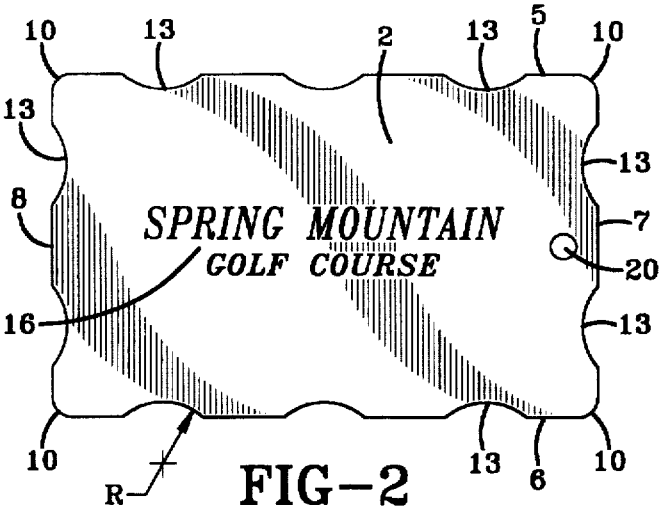
FIG. 2 is a plan view of the support card of FIG. 1.

In accordance with one of the features of the present invention, at least one and preferably a plurality of concave notches 13 are formed in side edges 5 and 6. Three notches are formed in each of the side edges as shown particularly in FIGS. 1 and 2. At least one and preferably two notches 13 are formed in end edges 7 and 8 and are spaced equally from each other and from corners 10. Likewise, notches 13 are preferably spaced equally apart and the same distance from corners 10 to provide a symmetrical arrangement of notches in edges 5 and 6. The notches preferably are similar to each other and have a smooth concave configuration which in the preferred embodiment has a radius R (FIG. 2) of approximately 0.38 inches.

Furthermore, in accordance with one of the features of the invention, printed indicia 16 and 17 will be placed on surfaces 2 and 3, respectively. The indicia preferably will in the form of an advertisement, such as the name of a particular golf course or product, as public officials or other applications. Since card 1 is of an extremely inexpensive construction it will in many instances be given as promotional items free of charge to the golfers for such advertising purposes.

A small hole 20 may be formed in card 1 extending completely therethrough and located adjacent to one of the end edges. Hole 20 may be used to support a plurality of the cards on a hook or could have a string or chain or other type of attachment means extending therethrough.

Figure 3:
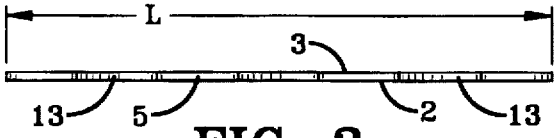
FIG. 3 is a view of one of the side edges of the card of FIG. 2.
Figure 4:
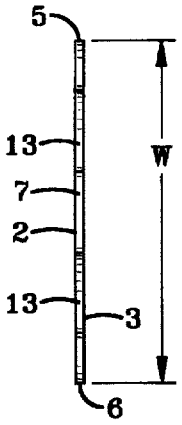
FIG. 4 is a view of one of the end edges of the card shown in FIG. 2.

In further accordance with the invention, card 1 closely resembles a usual plastic credit card in both size and thickness, and will have a length L (FIG. 3) of approximately 3 5/16 and a width W (FIG. 4) of approximately 2 1/8. Likewise, the thickness of the card is approximately 0.025 inches, which will provide a sturdy, yet flexible, extremely lightweight card, which can be carried by the golfer in his or her wallet or pocket, or attached to the golf cart by a string or the like extending through hole 20. As shown in the drawings, edges 5–8 will be straight and thus will provide straight sections of the edges between the recesses and outwardly therefrom until they merge into rounded corners 10.

Figure 5:
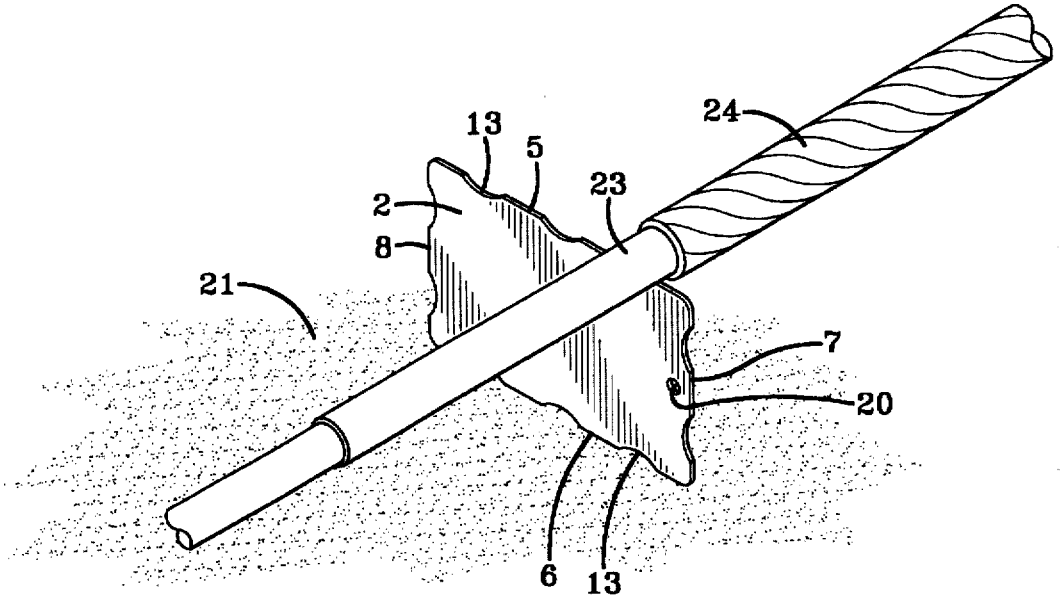
FIG. 5 is a diagrammatic perspective view showing the support card of the present invention supporting the grip of a golf club shaft above the ground.

The manner of use of card 1 is shown in FIG. 5 wherein in one side edge is set upon ground 21 and a shaft 23 of a golf club is placed in one of the notches 13 so that the grip 24 is raised above the ground to prevent it from becoming damp or soiled since these grips many times are formed of leather or other material which could be effected by moisture. Should the grass be relatively high, card 1 can be rotated 90° so that one of the end edges 6 or 7 is placed on the ground raising the grip 24 to a higher elevation to prevent it from becoming wet.

Card 1 need not be inserted or stuck into the ground as are other club supporting devices, and therefore is unaffected by hard, rocky or sandy soil, and most importantly will cause no permanent mark on the ground, whether it be in the fairway, and particularly on the green.

In summary, card 1 provides an extremely simple, inexpensive, lightweight yet rugged device which can be used as a promotional item by having various advertisements and other printed indicia on one or both flat side surfaces of the card, which will be used by golfers temporarily for supporting the grip portion of the club off the ground without leaving any mark on the ground or green by use of the card since it is not inserted into the ground. Likewise, the card can be rotated in two different positions to obtain different elevations of the club grip above the ground depending upon the length of the surrounding grass.

Accordingly, the improved golf club support card is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved golf club support card is constructed an used, the characteristics of the construction, and the advantageous, new and useful results obtained; the new and useful structures, devices, elements, arrangements, parts and combinations, are set forth in the appended claims.

I claim:

1. A card for supporting a portion of a golf club shaft off of the ground, said card including a one piece member formed of plastic material having a substantially rectangular shape with a pair of opposed flat side surfaces defined by a pair of parallel end edges and a pair of parallel side edges, with at least one notch being formed in one of the end edges and in at least one of the side edges for receiving a shaft of a golf club therein when the opposite end edge or side edge is seated on the ground for supporting the card in an upright position, said card having a length of approximately 3 5/16 inches and a width of approximately 2 1/8 and printed indicia being placed on at least one of the side surfaces.

2. The card defined in claim 1 in which a hole is formed in the card adjacent one of the end edges for receiving a supporting device.

3. The card defined in claim 1 in which at least two of the concave notches are formed in each of the side edges and end edges; and in which said notches have a smooth concave configuration.

4. The card defined in claim 1 in which the card includes four smoothly rounded corners.

5. The card defined in claim 1 in which three equally spaced notches are formed in each of the side edges and two equally spaced notches are formed in each of the end edges.

6. The card defined in claim 5 in which a straight section of the respective edge extends between each of the adjacent pair of notches.

7. The card defined in claim 5 in which each of the notches are similar in width and depth to each other.

8. In combination, a golf club shaft having a grip end and a card for supporting said grip end off of the ground, said card being a one piece member formed of a plastic material having a substantially rectangular shape with a pair of opposed flat side surfaces defined by a pair of parallel end edges and a pair of parallel side edges, at least one notch formed in at least one of the end or side edges for receiving the shaft of the golf club therein when an opposite end edge or side edge is seated on the ground and supporting the card in an upright position; and printed indicia being on at least one of the side surfaces.

9. The card defined in claim 8 in which a hole is formed in the card adjacent one of the end edges for receiving a supporting device.

10. The card defined in claim 8 in which at least two notches are formed in each of the side edges and end edges.

11. The card defined in claim 10 in which the notches have a smooth concave configuration and are equal to each other and have a radius of curvature of 0.38 inches.

12. The card defined in claim 8 in which the card has a length of approximately 3 5/16 inches and a width of approximately 2 1/8 inches.

13. The card defined in claim 8 in which the card has a thickness of approximately 0.25 inches measured between the pair of opposed side surfaces.

14. The card defined in claim 8 in which printed indicia is on both of the flat side surfaces.

15. A card for supporting a portion of a golf club shaft off of the ground, said card including a one piece member formed of plastic material having a substantially rectangular shape with a pair of opposed flat side surfaces defining a pair of parallel planes, a pair of parallel end edges and a pair of parallel side edges, said end and side edges lying entirely between the pair of planes defined by the side surfaces, with at least one notch being formed in one of the edges for receiving a shaft of a golf club therein when the edge opposite of said one edge is seated on the ground for supporting the card in an upright position; and printed indicia being placed on at least one of the side surfaces.

16. The card defined in claim 15 in which the card has a length of approximately 3 5/16 inches and a width of approximately 2 1/8 inches.

17. The card defined in claim 16 in which the card has a thickness of approximately 0.025 inches measured between the pair of opposed side surfaces.

18. The card defined in claim 15 in which a hole is formed in the card adjacent one of the edges for receiving a supporting device.

19. The card defined in claim 15 in which the card includes four smoothly rounded corners.

20. The card defined in claim 15 in which the card has a thickness of approximately 0.025 inches measured between the pair of opposed side surfaces.

* * * * *